US005952940A

United States Patent [19]

Matsumoto

[11] Patent Number: 5,952,940

[45] Date of Patent: Sep. 14, 1999

[54] MOVING-BODY COMMUNICATION DEVICE

[75] Inventor: Manabu Matsumoto, Handa, Japan

[73] Assignee: Denso Corporation, Kariya, Japan

[21] Appl. No.: 09/115,591

[22] Filed: Jul. 15, 1998

[30] Foreign Application Priority Data

Jul. 16, 1997 [JP] Japan ..... 9-191005

[51] Int. Cl.[6] ..... G08G 1/09

[52] U.S. Cl. ..... 340/905; 340/928; 340/917; 340/931

[58] Field of Search ..... 340/905, 928, 340/917, 930, 931, 938

[56] References Cited

U.S. PATENT DOCUMENTS

| | | | |
|---|---|---|---|
| 5,541,928 | 7/1996 | Kobayashi et al. | 370/95.1 |
| 5,554,984 | 9/1996 | Shigenaga et al. | 340/937 |
| 5,581,249 | 12/1996 | Yoshida | 340/928 |
| 5,640,156 | 6/1997 | Okuda et al. | 340/928 |
| 5,705,996 | 1/1998 | Eguchi et al. | 340/928 |
| 5,751,227 | 5/1998 | Yoshida et al. | 340/928 |
| 5,771,008 | 6/1998 | Hayashi et al. | 340/905 |
| 5,777,565 | 7/1998 | Hayashi et al. | 340/928 |

FOREIGN PATENT DOCUMENTS

| | | |
|---|---|---|
| 62-183231 | 8/1987 | Japan . |
| 9-134494 | 5/1997 | Japan . |

*Primary Examiner*—Jeffrey A. Hofsass
*Assistant Examiner*—Toan N. Pham
*Attorney, Agent, or Firm*—Pillsbury Madison & Sutro LLP

[57] ABSTRACT

When a vehicle-mounted device receives a FCM signal from a road-side communication device, the vehicle-mounted device receives or transmits a data signal in accordance with a link direction and a time slot specified by the FCM signal. When the vehicle-mounted device does not receive a signal to be received within an expected time, or when it transmits an ACK signal which is a last signal of communication, retry processing starts. In this retry processing, the vehicle-mounted device determines the contents of communication processing to be next carried out from both the contents of the signal transmitted from the road-side communication device and the contents of the last time communication processing.

13 Claims, 14 Drawing Sheets

MOVING-BODY COMMUNICATION DEVICE

CROSS REFERENCE TO RELATED APPLICATION

This application is based upon and claims the benefit of priority of the Prior Japanese Patent Application No. H. 9-191005 filed on Jul. 16, 1997, the contents of which are incorporated herein by reference.

BACKGROUND OF THE INVENTION

1. Field of the Invention

This invention relates to a moving-body communication device which is installed in a moving body and transmits a response signal for answering an interrogation signal which is received in a communication area of an interrogator.

2. Prior Arts

An automatic toll-collection system in which the toll charges are settled without stopping vehicles at a tollgate has been considered. In a conventional automatic toll-collection system, when a vehicle passes through a predetermined communication area of an interrogator, various kinds of data are exchanged between the interrogator and a vehicle-mounted device through radio communication to automatically execute toll charging on the traveling vehicle. As a result, the occurrence of traffic congestion at the tollgate can be suppressed, and rationalization of the toll collection can be promoted.

In such an automatic toll-collection system, it is necessary to dispose an antenna of a road-side communication device serving as an interrogator at an entrance or an exit of a toll road. Also, it is necessary to provide a vehicle-mounted device for radio communication on each of the vehicles which travel the toll road. Further, in a communication processing to execute toll charging, it is necessary to reliably complete toll collection in a short time during which the vehicle passes through the communication area of the antenna.

In general, radio communication receives adverse influences from a wind shield and a wiper of a vehicle, the weather such as rain, snow, thunder, a device outputting radio waves of a micro wave frequency band (for example, an automatic speed regulation device), a radio communication device outputting illegal radio waves and the like. Therefore, a possibility that a transmission/reception error occurs in radio communication is higher than that in wire communication.

When the transmission/reception error has occurred, for example, when a vehicle-mounted device does not receive a transmission signal from a road-side communication device, which is to be received by the vehicle-mounted device, the vehicle-mounted device transmits a retransmission request signal to the road-side communication device so that the road-side communication device outputs the transmission signal again to maintain accurate communication as much as possible. In this case, as shown in FIGS. 14 and 15, signals are exchanged between the vehicle-mounted device and the road-side communication device.

Referring to FIGS. 14 and 15, first, a communication processing between the vehicle-mounted device and the road-side communication device is explained and then the problems of the processing shown in FIGS. 14 and 15 are explained.

The road-side communication device 1 outputs a signal so that each of vehicle-mounted devices 2 specifies a communication frame to execute communication without generating crosstalk even when plural vehicle-mounted devices 2 are in a communication area of the road-side communication device 1. That is, the road-side communication device 1 transmits the signal termed a frame control message (FCM) in advance, thereby specifying, for each of the vehicle-mounted devices 2, a time slot through which signals are transmitted therebetween at a first unit communication. Further, the FCM signal also provides up-link designation or down-link designation at a second and later unit communications.

When the road-side communication device 1 transmits data to the vehicle-mounted device 2, that data is transmitted as a transmission signal during a time slot that is specified by the FCM signal. When the vehicle-mounted device 2 receives the transmission data signal at timing of the time slot specified as described above, the vehicle-mounted device 2 returns an acknowledgment (ACK) signal representing the reception of the transmission data signal to the road-side communication device 1. Thereby, a single unit communication ends.

When the communication processing needs to be continuously carried out, the road-side communication device 1 transmits signals again. If a command instructing that the vehicle-mounted device 2 transmits a data signal to the road-side communication device 1 is provided as the FCM signal transmitted from the road-side communication device 1, the vehicle-mounted device 2 transmits the data signal during the specified time slot. When the road-side communication device 1 receives the data signal from the vehicle-mounted device 2, it transmits an ACK signal to the vehicle-mounted device 2. By repeating the unit communication in this manner, a sequence of the communication processing is carried out to complete toll charging.

In the case described above, after signals are exchanged between the road-side communication device 1 and the vehicle-mounted device 2 to establish a link sequence therebetween, a communication processing for transmitting data is carried out. In the process of the communication processing for transmitting data, if a radio signal reception error occurs, the following problems are caused.

For example, FIG. 14 shows a case in which, when the FCM signal of an up-link designation is transmitted from the road-side communication device 1, although the vehicle-mounted device 2 transmits a data signal to the road-side communication device 1 using a data response frame and the road-side communication device 1 returns the ACK signal to the vehicle-mounted device 2 in response thereto, the vehicle-mounted device 2 cannot receive the ACK signal even after the elapse of an expected time because of any problems. Because the vehicle-mounted device 2 does not receive the ACK signal, the vehicle-mounted device 2 determines that a signal reception error has occurred, i.e., the data signal transmitted using the data response frame does not reach the road-side communication device 1. Therefore, the vehicle-mounted device 2 waits until the road-side communication device 1 provides the FCM signal of the up-link designation again to retransmit the data signal to the road-side communication device 1.

On the other hand, because the road-side communication device 1 has transmitted the ACK signal in response to the data signal from the vehicle-mounted device 2, the road-side communication device 1 proceeds with the communication processing regarding the communication as being normally carried out. Therefore, the road-side communication device 1 transmits an FCM signal of a down-link designation for requesting data writing to proceed to a next sequence. It is to be noted that the reason that such a situation happens is in that the ACK signal itself is an acknowledgement signal, and there is no way for further ascertaining whether the vehicle-mounted device 2 can receive the ACK signal.

Because the FCM signal includes the down-link designation and it is not to be received, the vehicle-mounted device 2 cannot accept that FCM signal. Therefore, even though the road-side communication device 1 transmits the data writing request signal (the FCM signal of the down-link designation), the vehicle-mounted device 2 neither accepts it nor returns an ACK signal in response thereto. At this time, because the road-side communication device 1 cannot obtain a response signal responsive to the FCM signal of the down-link designation, it determines that a radio signal reception error has occurred at a vehicle-mounted device side and retransmits the FCM signal of the down-link designation (first retry).

After that, this retry operation is repeated. However, if the number of the retry operations reaches predetermined times, the road-side communication device 1 discontinues the communication processing regarding it as retry-out. At this time, because the vehicle-mounted device 2 does not receive the FCM signal of the up-link designation in a stand-by condition, the vehicle-mounted device 2 may fall in a state that it cannot escape from the stand-by condition if the worst happens. In this case, even if the vehicle-mounted device 2 releases the stand-by condition for receiving the FCM signal of the up-link designation when a time for the retry processing is out, it is impossible to avoid an inefficient communication processing. Further, such an inefficient communication processing limits communication times for the other vehicles which concurrently pass through the tollgate.

Also, FIG. 15 shows a case in which, when the vehicle-mounted device 2 receives a data signal transmitted using a data writing command frame following to the FCM signal of the down link designation from the road-side communication unit 1, although the vehicle-mounted device 2 returns the ACK signal to the road-side communication device 1 to terminate the communication processing, the road-side communication device 1 cannot receive that ACK signal. Because the road-side communication device 1 does not receive the ACK signal, it determines that a radio signal reception error has occurred at the vehicle-mounted device side. Therefore, the road-side 5 communication device 1 transmits the FCM signal of the down-link designation again to retransmits the data signal using the data writing command frame (first retry).

At this time, because the vehicle-mounted device 2 has completed the communication processing for toll charging by transmitting the ACK signal as the last signal of the communication processing, the vehicle-mounted device 2 is in a state for accepting a FCM signal of no link direction instruction from the road-side communication device 1 to start another communication processing. Therefore, even when the vehicle-mounted device 2 receives the FCM signal of the down-link designation which is to carry out the retry operation from the road-side communication device 1, the vehicle-mounted device 2 does not respond to this signal regarding the sequence of the communication processing as erroneous.

As a result, after the retry operation is repeated predetermined times in the road-side communication device 1, the road-side communication device 1 determines that the processing for toll charging is incomplete. That is, although the road-side communication device 1 only fails to receive the ACK signal as the last signal, and the communication processing for toll charging is substantially completed, the toll collection cannot be carried out.

SUMMARY OF THE INVENTION

The present invention is made in view of the above problems and its object is to provide a moving-body communication device which can certainly complete a communication processing without wasting time even though a radio signal reception error occurs.

A moving-body communication device according to the present invention starts to communicate with an interrogator in response to a signal from the interrogator when the moving-body communication device passes through a communication area of the interrogator. After that, signals are exchanged between the moving-body communication device and the interrogator to execute a sequence of communication processing. In the sequence of the communication processing, when the moving-body communication device does not receive a signal that is to be transmitted from the interrogator and is to be received thereby within an expected time, a communication control device provided in the moving-body communication device carries out a retry processing. That is, the communication control device controls the progress of the communication processing to be continued in consideration of a progressing state of the communication processing which has already been carried out. Therefore, the communication control device can continue or stop the communication processing in consideration of the progressing state of the communication processing. Further, when the communication processing is continued, the communication processing can be reliably carried out in a short time. As a result, when the interrogator concurrently communicates with another moving-body communication device, it is possible to prevent the communication processing between one moving-body communication device and the interrogator from wasting a communication time for another moving-body communication device.

The communication control device preferably controls the progress of the communication processing in accordance with contents of the signal that the communication control device receives from the interrogator after the retry processing starts. As a result, it is possible to estimate the progressing state of the communication processing at an interrogator side based on the contents of the signal received after the retry processing starts and the contents of the signal to be received that has caused the retry processing. Therefore, the communication control device can appropriately control the communication processing to be continued based on the estimation of the progressing state of the communication processing at the interrogator side.

If the moving body communication device does not receive a signal from the interrogator within a predetermined retry time after the retry processing starts, the communication control device preferably stops the communication processing determining that any failure has occurred in the progress of the communication processing. In this case, the communication control device restarts the communication processing from the beginning. As a result, it is possible to prevent time from being wasted, for example, by unnecessarily repeating a retransmission request, whereby the communication processing can be carried out promptly and reliably.

BRIEF DESCRIPTION OF THE DRAWINGS

These and other objects, features and characteristics of the present invention will be appreciated from a study of the following detailed description, the appended claims, and drawings, all of which form a part of this application. In the drawings:

DETAILED DESCRIPTION OF THE PREFERRED EMBODIMENTS

A first embodiment in which the present invention is applied to a vehicle-mounted device used in an automatic toll collection system for a toll road is described with reference to FIG. 1 through FIG. 13.

Figure 2:
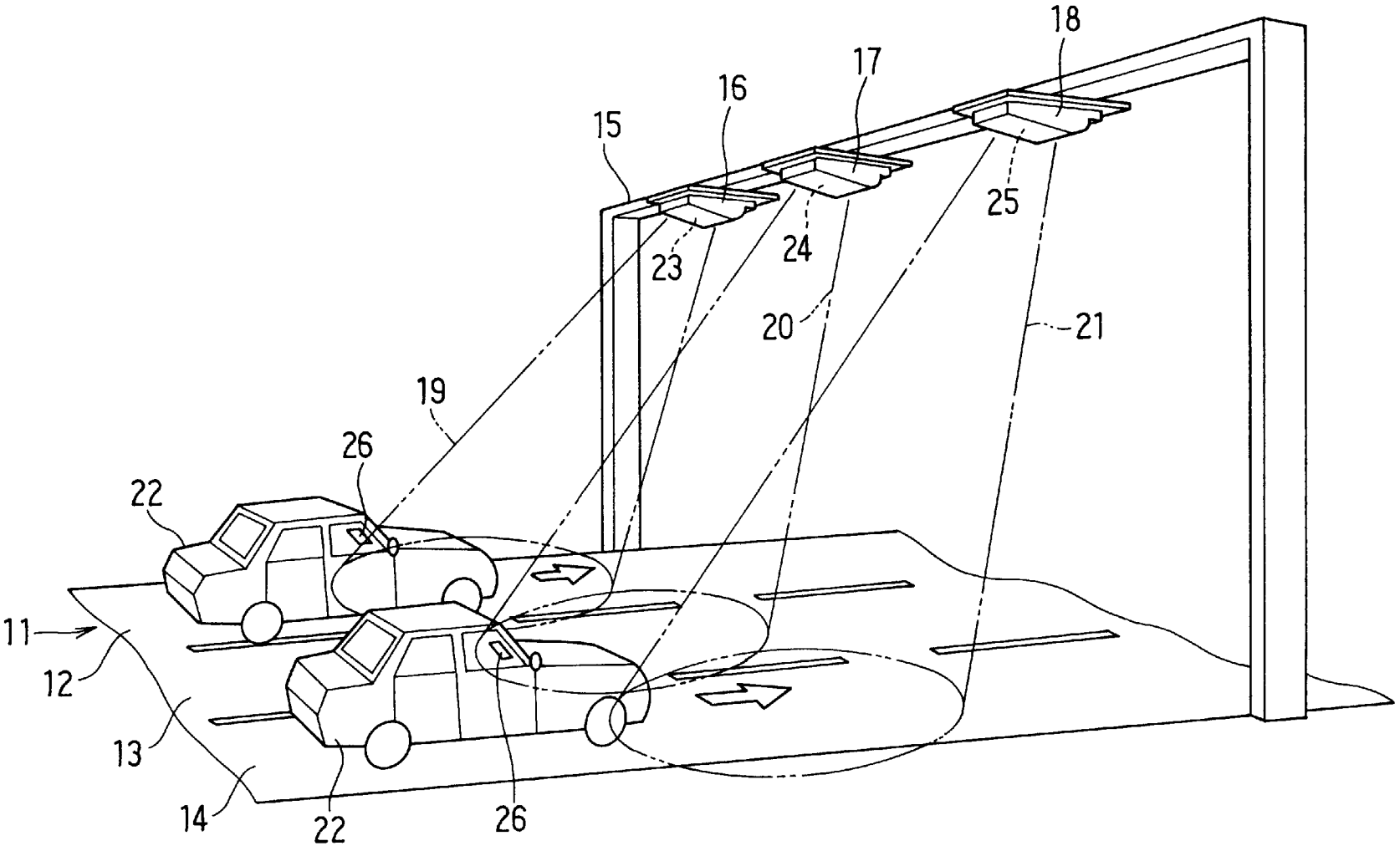
FIG. 2 is a view showing a state that a vehicle-mounted device is in a communication area of a road-side communication device.

In FIG. 2, a toll road 11 has three lanes 12, 13, 14 on one side (only one side of the road is shown in FIG. 2). A gantry 15 is built over the road 11 at a predetermined toll charging place. On the gantry 15, road-side communication devices 16–18 as interrogators are disposed corresponding to each of the lanes 12–14 so that they are directed downward. Communication areas 19–21 are established on each lanes due to the road-side communication devices 16–18.

Each of the road-side communication devices 16–18 is provided with an antenna 23–25 and a control circuit disposed in a base attached on the lower face of the gantry 15. Each of the road-side communication devices 16–18 has a waterproof structure in which the overall outer surface thereof is covered with a resin cover through which radio waves can pass. The control circuits of the road-side communication devices 16–18 transmit and receive signals through the antennas 23–25, respectively.

The antennas 23–25 are constructed so that a radio wave radiating/receiving face can be adjusted. Thereby, the communication areas 19–21 can be also adjusted. Although not shown in the figure, each of the antennas 23–25 is a micro strip type array antenna which is formed by forming eight patches of a square shape on one side of a print substrate, by joining the eight patches with a transmission line, and by connecting the joined patches to a power supply terminal.

Vehicle-mounted device 26, as a moving-body communication device of the present invention, is installed in the vicinity of a dashboard of each of automobiles 22 which are vehicles traveling the toll road 11. In each of the vehicle-mounted devices, an antenna 27 is provided so that a radio communication signal can be received from and transmitted to one of the road-side communication devices 16–18. The antenna 27 is a micro strip type array antenna in which two patches of a square shape are formed on a print substrate, similar to the antennas 23–25.

Figure 3A:
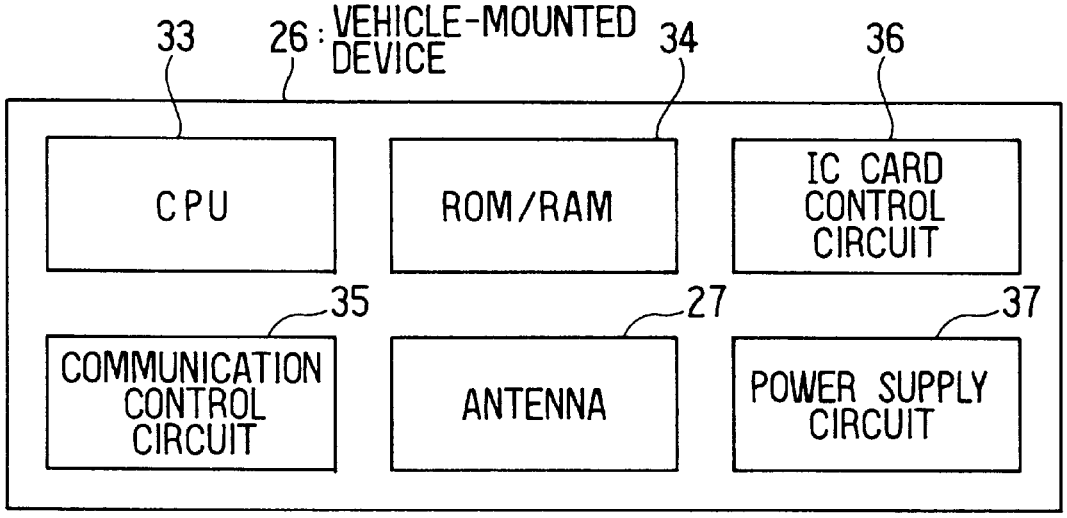
FIGS. 3A and 3B are block diagrams of the electrical circuits of the vehicle-mounted device and the road-side communication device.
Figure 3B:
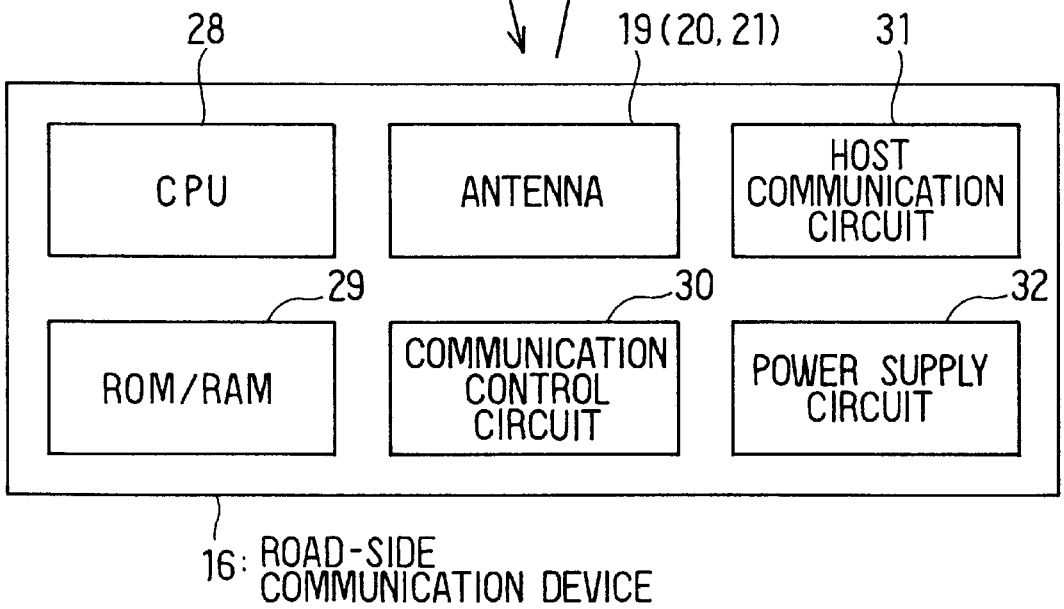

The details of the control circuit of each of the road-side communication devices 16–18 are described with reference to FIG. 3B. Because the control circuits of the road-side communication devices 16–18 have the same structure, only the structure of the control circuit of the road-side communication device 16 is explained.

The control circuit of the road-side communication device 16 includes a CPU 28, a ROM/RAM 29, a communication control circuit 30, a host communication circuit 31, and a power supply circuit 32. The CPU 28 executes various kinds of arithmetic processing and communication processing based on programs and data stored in the ROM/RAM 29. The communication control circuit 30 controls communication with the vehicle-mounted device 26 and carries out signal processing such as modulation and demodulation of the radio communication signal. The host communication circuit 31 controls communication with a host computer that supervises the road-side communication devices 16–18 and executes processing of data obtained therefrom.

The vehicle-mounted device 26 is structured by a CPU 33, ROM/RAM 34, a communication control circuit 35, an IC card control circuit 36, and a power supply circuit 37, in addition to the antenna 27. The CPU 33 executes various kinds of arithmetic processing and a processing of signals communicated with the road-side communication device 16 based on programs and data stored in the ROM/RAM 34. The communication control circuit 35 controls communication with the road-side communication device 26 and carries out signal processing such as modulation and demodulation of the radio communication signal. The IC card control circuit 36 control the exchange of data with the IC card inserted in a slot of an IC card interface.

Next, the operation of the present embodiment is described.

First, a communication procedure of the present embodiment is briefly explained with reference to FIGS. 4, 5. When a signal reception error happens in the communication processing according to the communication procedure, a retry processing is carried out. The contents of the retry processing is described with reference to FIGS. 1 and 6–13.

In the present embodiment, the communication procedure of a half duplex communication is adopted. That is, signals are always exchanged between the road-side communication device 16 (17, 18) and the vehicle-mounted device 26 based on a time slot and a link direction designated by a frame control message (FCM) signal transmitted from the road-side communication device 16 (17, 18). Also, in the vehicle-mounted device 26, an ID code included in the FCM signal is ascertained whether normal or abnormal. When the ID code is normal, communication with the road-side communication device 16 (17, 18 ) is allowed.

Figure 4:
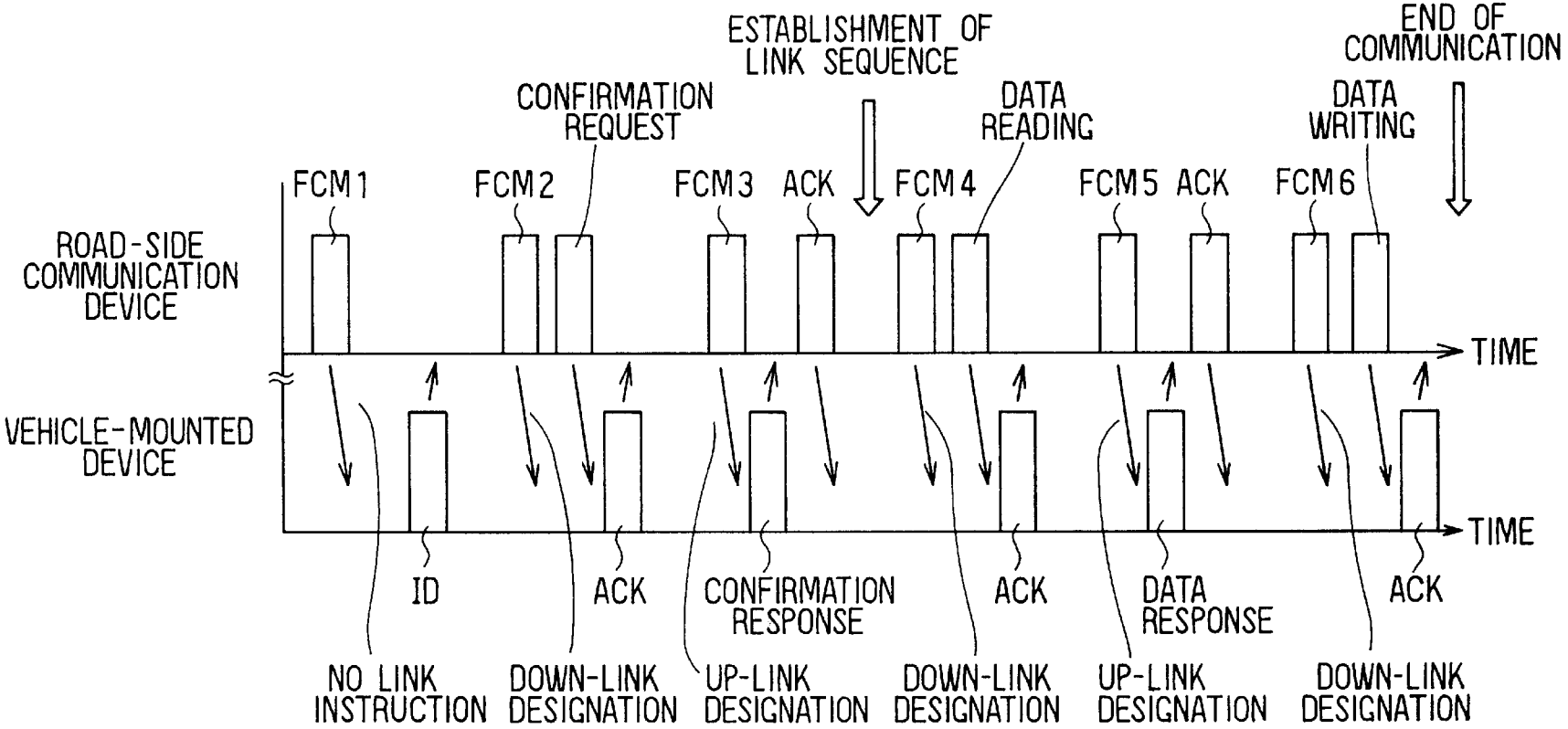
FIG. 4 is a time chart showing a communication processing between the vehicle-mounted device and the road-side communication device.
Figure 5:
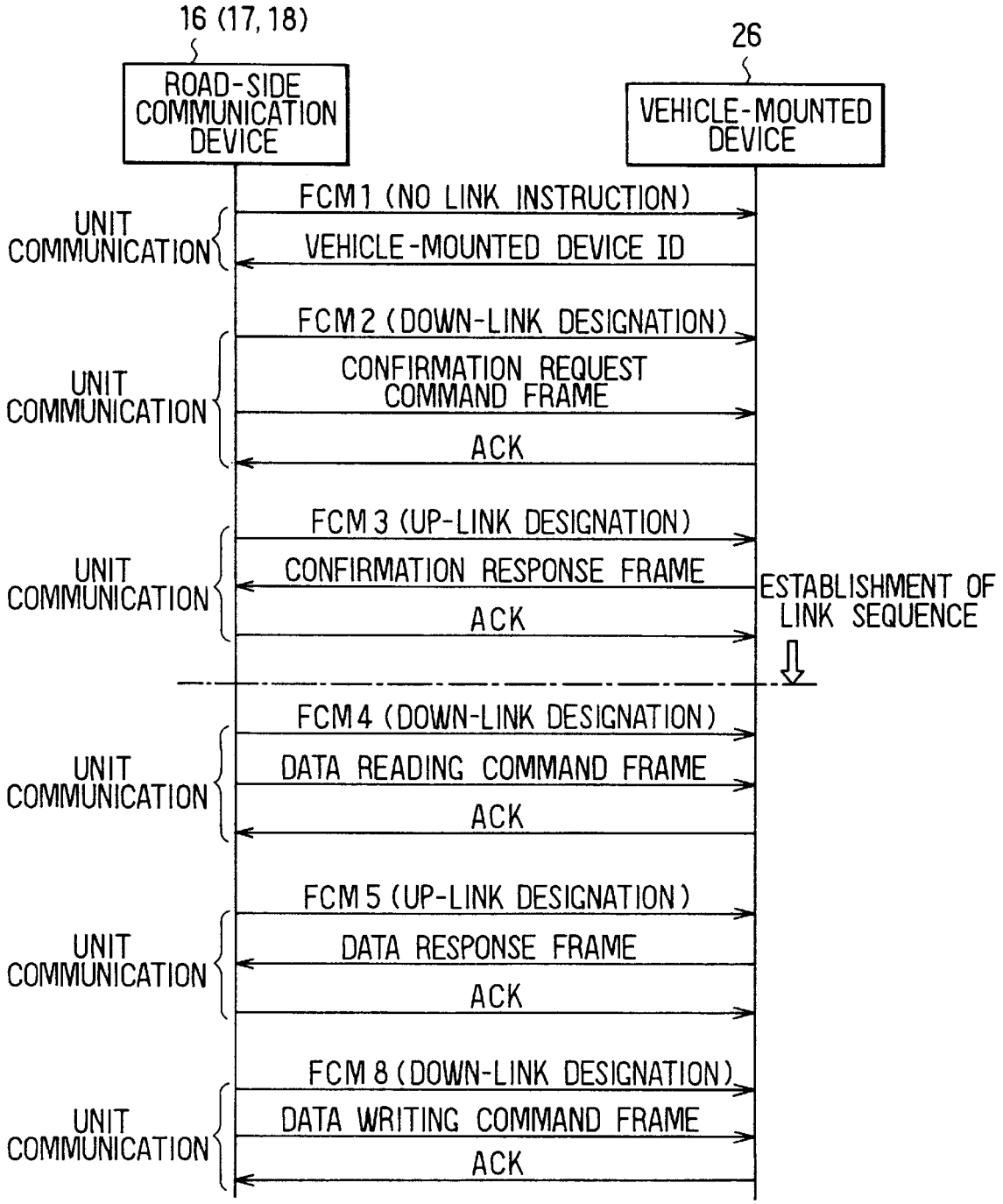
FIG. 5 is a view showing a sequence of the communication processing shown in FIG. 4.

FIGS. 4 and 5 show a typical sequence of communication processing between the vehicle mounted device 26 and the road-side communication device 16. The road-side communication device 16 transmits an FCM1 signal of no link directional instruction at predetermined intervals before starting communication with the vehicle-mounted device 26 passing through the communication area 19. When a single unit communication is executed by the vehicle-mounted device 26 transmitting a vehicle-mounted device ID upon receiving the FCM1 signal, communication starts between the road-side communication device 16 and the vehicle-mounted device 26.

The road-side communication device 16 starts a second unit communication by transmitting a FCM2 signal of a down-link designation to transmit a confirmation request command. When the vehicle-mounted device 26 receives the confirmation request command which is transmitted at a time slot specified by the FCM2 signal, the vehicle-mounted device 26 transmits an acknowledgement (ACK) signal representing a reception of the confirmation request command. Thereby, the second unit communication ends.

In a third unit communication, the road-side communication device 16 transmits a FCM3 signal of an up-link designation to obtain a confirmation response from the vehicle-mounted device 26. When the vehicle-mounted device 26 receives the FCM3 signal, it transmits a confirmation response signal at a time slot specified by the FCM3 signal. The road-side communication device 16 transmits an ACK signal in response to the confirmation response signal received. Thereby, confirmations of the both are finished, and a link sequence is established between the road-side communication device 16 and the vehicle-mounted device 26. After that, communication to exchange necessary data is carried out between the road-side communication device 16 and the vehicle-mounted device 26.

That is, in a fourth unit communication, the road-side communication device 16 transmits a FCM4 signal of a down-link designation to transmit a data reading command. Following the FCM4 signal, the data reading command is transmitted at a specified time slot. When the vehicle-mounted device receives the data reading command at the specified time slot, it transmits the ACK signal in response thereto. Sequentially, in a fifth unit communication, the road-side communication unit 16 transmits a FCM5 signal of an up-link designation to receive a data response signal from the vehicle-mounted device 26. When the vehicle-mounted device 26 receives the FCM5 signal, it transmits the data response signal at the specified time slot. The road-side communication device 16 transmits the ACK signal in response to the data response signal received.

In a sixth unit communication which is a last unit communication in this communication processing, the road-side communication device 16 transmits a FCM6 signal of a down-link designation to transmit a data writing signal. Following the FCM6 signal, the data writing signal is transmitted at the specified time slot. When the vehicle-mounted device 26 receives the data writing signal at the specified time slot after receiving the FCM6 signal, it transmits the ACK signal to finish the sequence of the communication processing. The road-side communication device 16 determines that the sequence of the communication processing ends when receiving the ACK signal from the vehicle-mounted device 26. Then, the road-side communication device 16 transmits the FCM1 signal of no link direction instruction to start another communication.

Figure 1:
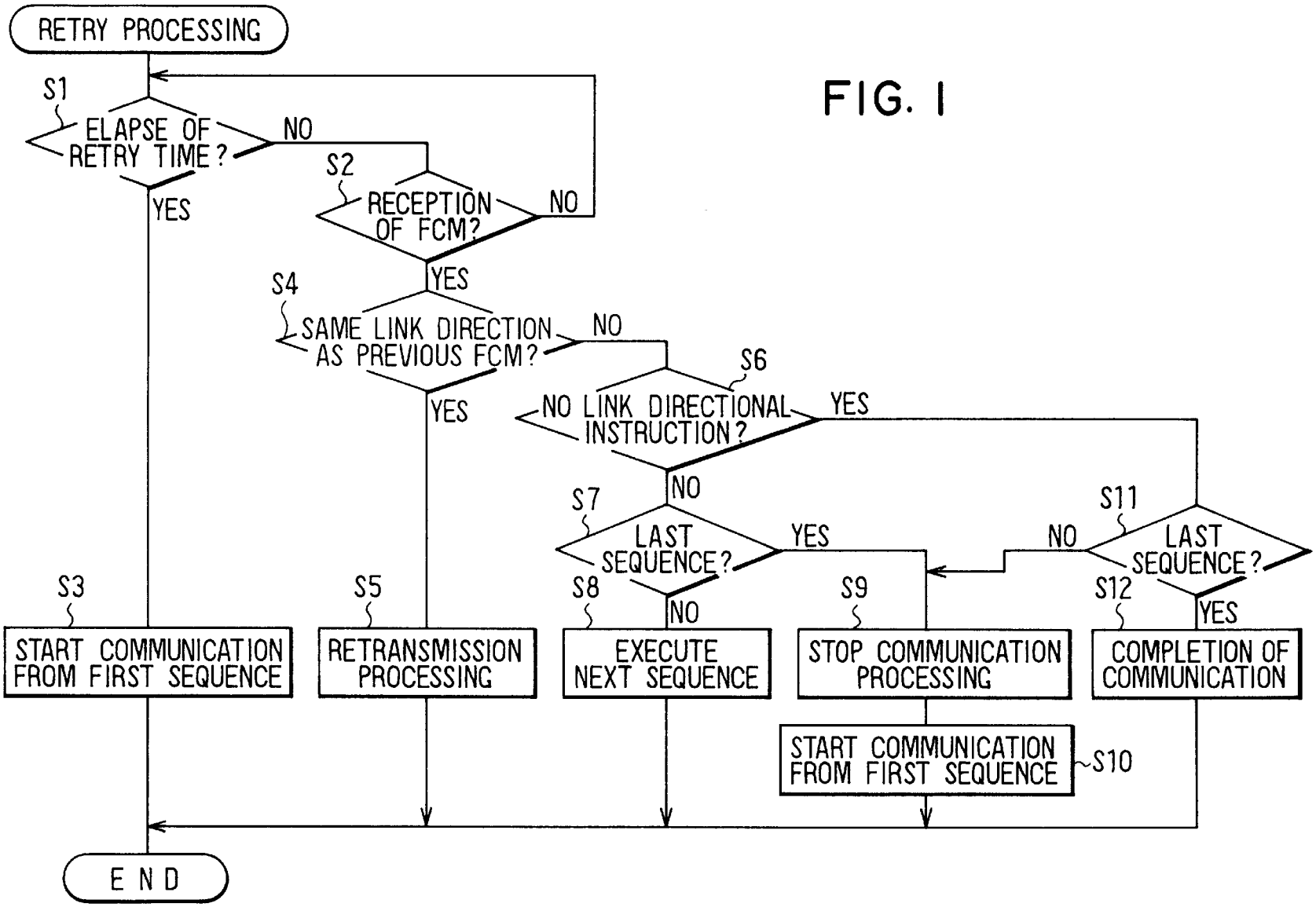
FIG. 1 is a flow diagram showing a retry processing program according to a first embodiment of the present invention.

In progress of the sequence of the communication processing, if a reception error happens in any of radio communication signals due to electric jamming or any communication trouble, and when the vehicle-mounted device 26 does not receive a signal to be received even after a predetermined expected time elapses, the vehicle-mounted device starts the retry processing shown in FIG. 1 to proceed with the communication processing promptly.

The vehicle-mounted device 26 activates a retry monitoring timer provided therein each time when receiving a signal from the road-side communication device 26. The retry monitoring timer counts a predetermined retry time. When the vehicle-mounted device 26 receives a next signal from the road-side communication device 16 within the retry time, the counted time of the retry monitoring timer is cleared, and the retry monitoring timer is restarted from the beginning.

Figure 6:
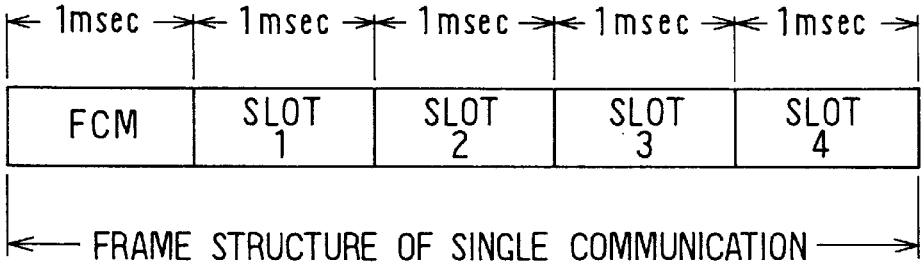
FIG. 6 is a view showing a structure of a single communication frame.
Figure 7:
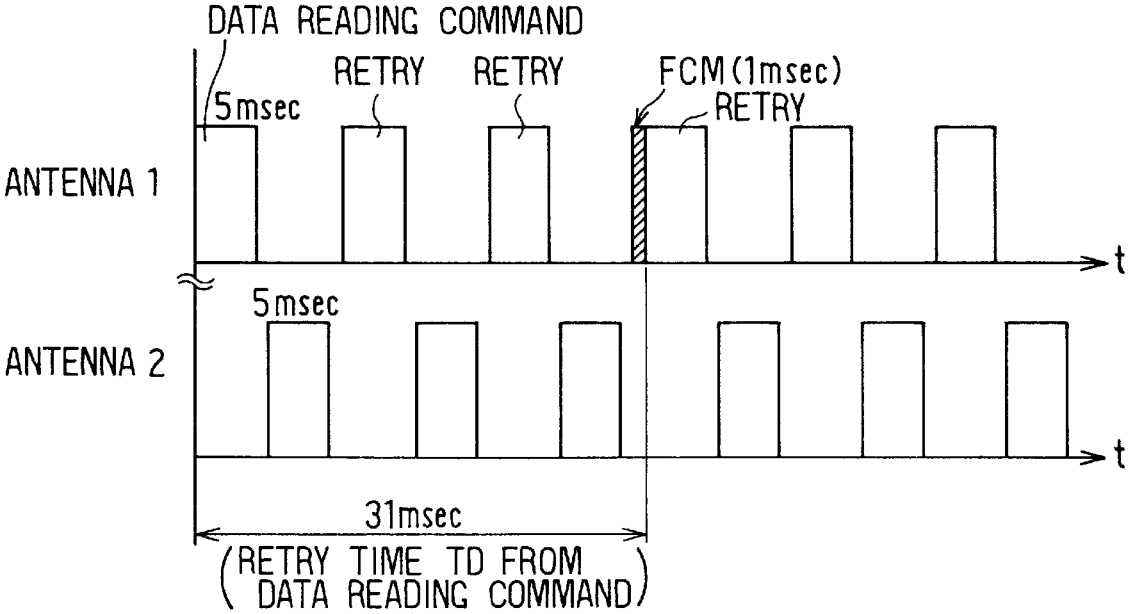
FIG. 7 is an explanatory view showing the setting of a retry time from a down-link designation.
Figure 8:
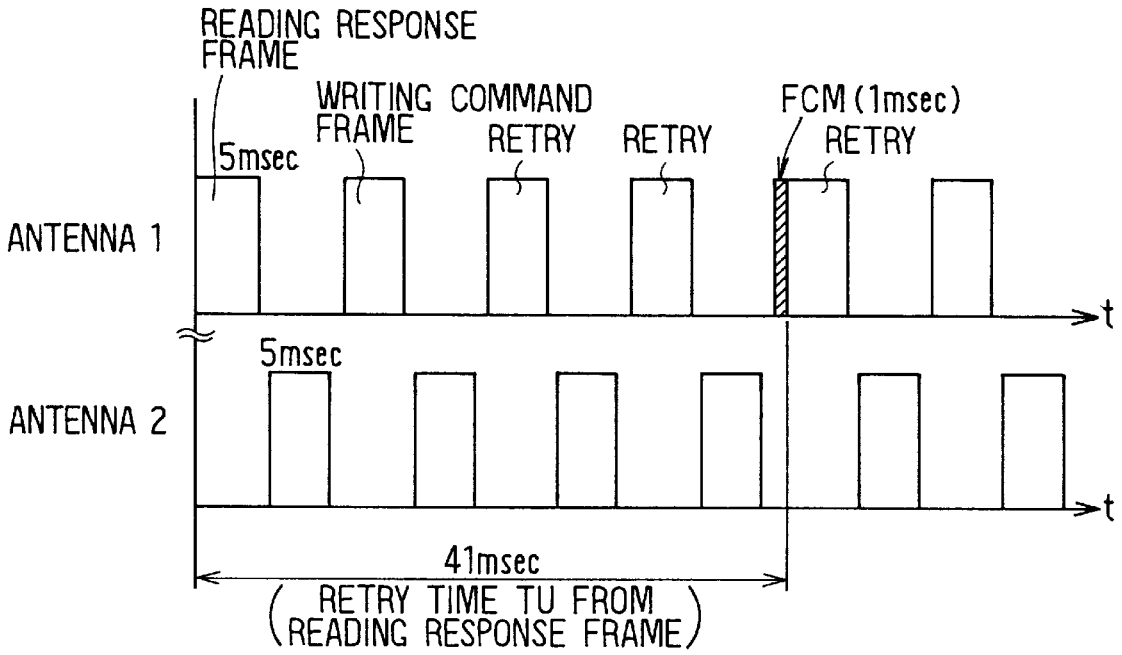
FIG. 8 is an explanatory view showing the setting of a retry time from an up-link designation.

In this case, the retry time is set, for example, as shown in FIGS. 6–8. In the example shown in FIGS. 6–8, a communication frame of a single communication is structured to include one FCM signal and four time slots. When the durations of the FCM signal and each time slot are 1 msec, a frame duration T of the single communication is 5 msec. The road-side communication device 16 communicates with the vehicle-mounted device 26 using radio waves while specifying one of the time slots. The road-side communication device 16 can communicate with four vehicle-mounted devices 26 at the most simultaneously.

The time chart of FIG. 7 shows a case in which, although the vehicle-mounted device 26 transmits an ACK signal in response to the data reading command (the link direction of the FCM signal is the down-link), the road-side communication device 16 cannot receive the ACK signal. In this case, assuming that a predetermined maximum retry number N is three times and two road-side communication devices transmit signals into their communication areas in a time-division manner (the number of the time division is represented as D (=2)), the retry time TD from the data reading command frame causing the retry processing is shown by the following equation (1).

$$TD=N\times T\times D+TFCM \quad (1)$$

wherein TFCM is a duration of the FCM signal.

In the example shown in FIG. 7, the value of the retry time TD is 31 ms. It is to be noted that the reason why only the duration of the FCM signal (TFCM) of a third retry frame is added is that the vehicle mounted device 26 can determine based on the link direction instruction of the FCM signal whether the third retry frame includes a signal to be received when receiving the FCM signal of the third retry frame.

The time chart of FIG. 8 shows a case in which, although the road-side communication device 16 transmits an ACK signal in response to the data reading response frame from the vehicle-mounted device 26 which is transmitted in response to the FCM signal of the up-link designation, the vehicle-mounted device 26 cannot receive the ACK signal. In this case, because the road-side communication device 16 cannot recognize such a situation, the road-side communication device 16 proceeds to a next sequence and transmits a data writing command frame. Therefore, it is necessary to consider the retry time including the data writing command frame, and the retry time TU from the data reading response frame is shown by the following equation (2).

$$TU=(N+1)\times T\times D+TFCM \quad (2)$$

In the example shown in FIG. 8, the value of the retry time TU is 41 ms.

Next, the retry processing is described in accordance with the flow chart shown in FIG. 1.

When the vehicle-mounted device 26 starts the retry processing, it is determined whether the counted time of the retry monitoring timer reaches the retry time TD or TU at step 1. When the counted time does not reach the retry time TD or TU, it is further determined whether the vehicle-mounted device 26 receives the FCM signal at step 2. If the FCM signal is not received even after the retry time TD or TU elapses ("YES" at step 1), the vehicle-mounted device 26 stops the communication processing and starts the communication processing again from the beginning at step 3. That is, the vehicle-mounted device 26 is in a state waiting for the FCM signal of no link direction instruction, i.e., the FCM signal allowing the vehicle-mounted device 26 to transmit the vehicle-mounted device ID code.

When the FCM signal is received before the retry time TD or TU elapses ("YES" at step 2), it is determined whether the link direction specified by the FCM signal that is newly received is the same as the link direction specified by the FCM signal received immediately before the retry processing starts (at step 4). When the link directions of the both FCM signals are identical ("YES" at step 4), the vehicle-mounted device 26 carries out a retransmission processing to transmit the communication signal having the same contents as those transmitted in the unit communication carried out immediately before the retry processing starts at step 5.

When the link directions of the both FCM signals are different from each other ("NO" at step 4), it is further determined whether the FCM signal that is newly received has no link directional instruction (at step 6). When the FCM signal has a link directional instruction ("NO" at step 6), it is determined whether it is now the last sequence of the communication processing at step 7. When the communication processing is not in the last sequence ("NO" at step 7), it can be determined that, although the unit communication is normally carried out in accordance with the link direction specified by the previous FCM signal, because the reception of the ACK signal in response thereto fails, the retry processing starts. Therefore, the unit communication specified by the FCM signal just received is continuously carried out to execute the next sequence of the communication processing at step 8.

On the other hand, when it is determined to be "YES" at step 7, that is, when the communication processing is in the last sequence, the FCM signals having different link directions cannot arise at this stage if the communication processing proceeds normally. Therefore, regarding any failure of occurring in the sequence of the communication processing, the vehicle-mounted device 26 stops the communication processing at step 9 and starts the communication processing again from the beginning at step 10.

In the vehicle-mounted device 26, when the FCM signal, that is received within the retry time after the retry processing starts, has no link directional instruction ("YES" at step 6), it is determined whether it is now the last sequence of the communication processing at step 11. When the communication processing is in the last sequence ("YES" at step 11), it can be determined that, although the retry processing is started because the vehicle-mounted device 26 fails to receive the ACK signal finally transmitted from the road-side communication device 16, the sequence of the communication processing has been completed in the road-side communication device 16 and the road side communication device 16 transmits a FCM signal of no link directional instruction to start another communication processing. Therefore, the vehicle-mounted device 26 also stops the sequence of the communication processing at step 12 regarding the communication processing of being completed.

On the other hand, when it is determined to be "NO" at step 11, that is, when the vehicle-mounted device 26 receives the FCM signal of no link directional instruction in spite of not the last sequence of the communication processing, regarding any failure of occurring in the communication processing of the road-side communication processing, the vehicle-mounted device 26 stops the communication processing at step 9 and starts the communication processing again from the beginning at step 10.

Even when a reception error occurs in receiving or transmitting any signal in the communication processing, if the vehicle-mounted device 26 carries out the retry processing as described above, the communication processing between the road-side communication device 16 and the vehicle-mounted device 26 can be smoothly promoted, compared to the case in which a conventional retry processing is carried out.

A table 1 summarizes the contents of the processing of FIG. 1.

TABLE 1

| type of sequence | new FCM | old FCM up link | old FCM down link |
|---|---|---|---|
| retry processing out of last sequence | no link direction up link | stop of communication retransmission | stop of communication next sequence retransmission |
| | down link | next sequence | |
| retry processing in last sequence | no link direction up link | completion of communication retransmission | completion of communication stop of communication retransmission |
| | down link | stop of communication | |

Next, the retry processing is described in more details, in correspondence with the progressing state of the communication processing.

Figure 9:
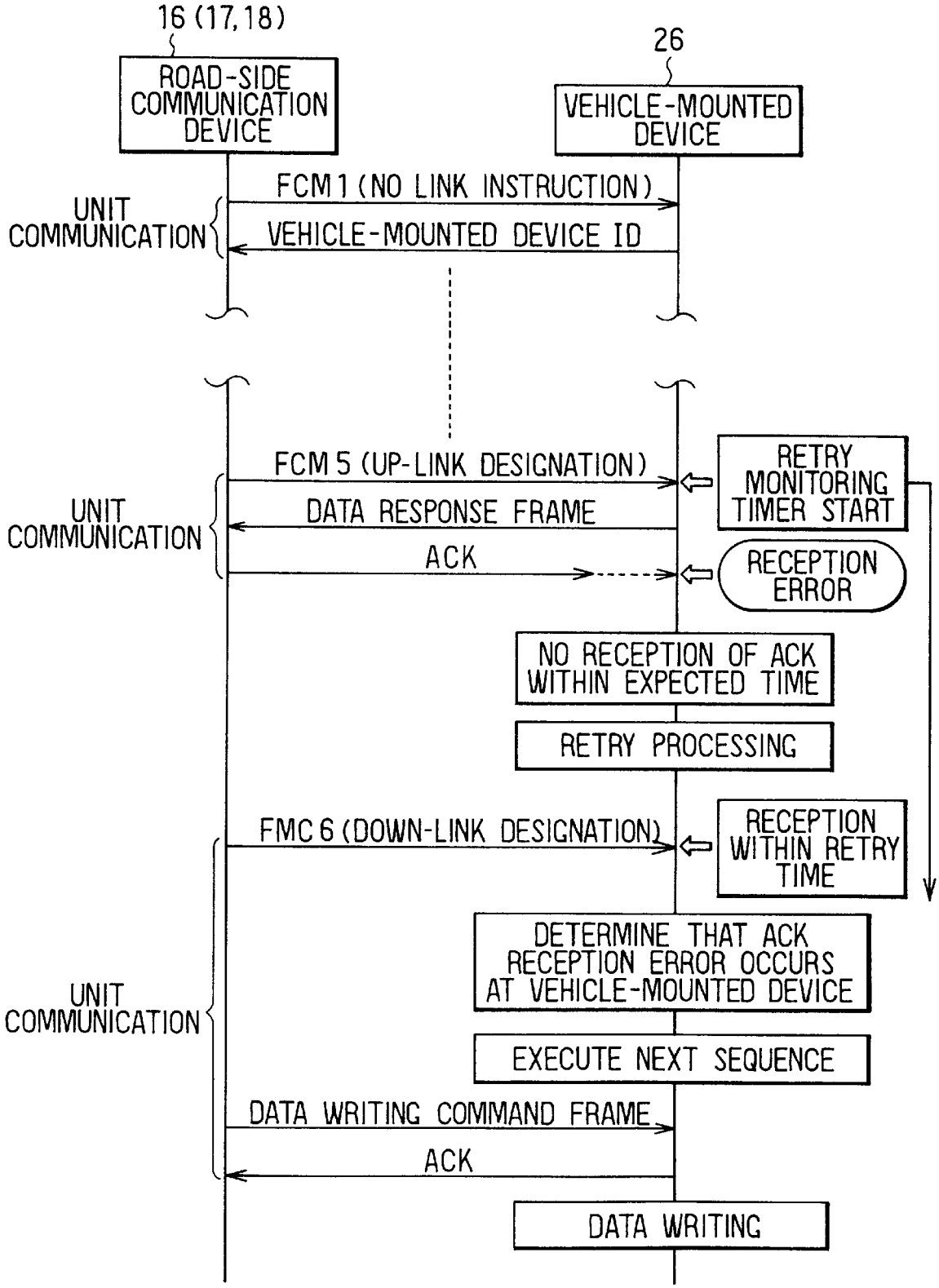
FIG. 9 is a view illustrating an operation of the vehicle-mounted device when a radio signal reception error occurs (first case)

(A) First Case (referred to FIG. 9, where step 8 in FIG. 1 is carried out)

The first case is a case where, after a link sequence is established between the road-side communication device 16 and the vehicle-mounted device 26 (due to the FCM1 signal to the FCM3 signal), and after communication for data transmission starts, when the road-side communication device 16 transmits the ACK signal in response to receiving the data response frame which is transmitted from the vehicle-mounted device 26 in response to the FCM5 signal of an up link designation transmitted from the road-side communication device 16, the reception error of the ACK signal occurs at the side of the vehicle-mounted device 26.

Although the vehicle-mounted device 26 does not receive the ACK signal transmitted from the road-side communication device 16 within the expected time, the road-side communication device 16 cannot recognize whether the vehicle-mounted device 26 receives the ACK signal. Therefore, the road-side communication device 16 moves to the transmission processing of the next unit communication and transmits a FCM 6 signal of a down link designation.

The vehicle-mounted device 26 starts the retry processing because the ACK signal is not received within the expected time. When the vehicle-mounted device 26 receives the FCM 6 signal from the road-side communication device 16 before the retry monitoring timer counts the retry time, the vehicle-mounted device 26 determines whether the progressing state of the communication processing is in the last sequence because the link directions of the both FCM signals are different from each other. At this time, because the communication processing is not in the last sequence, the vehicle-mounted device 26 determines that, although the road-side communication device 16 receives the data response frame and returns the ACK signal in response thereto, the vehicle-mounted device 26 fails to receive the ACK signal. In this case, because the data transmission itself has been carried out without any failure, the vehicle-mounted device 26 carries out the next sequence of the communication processing in accordance with the FCM6 signal that is just received.

Figure 14:
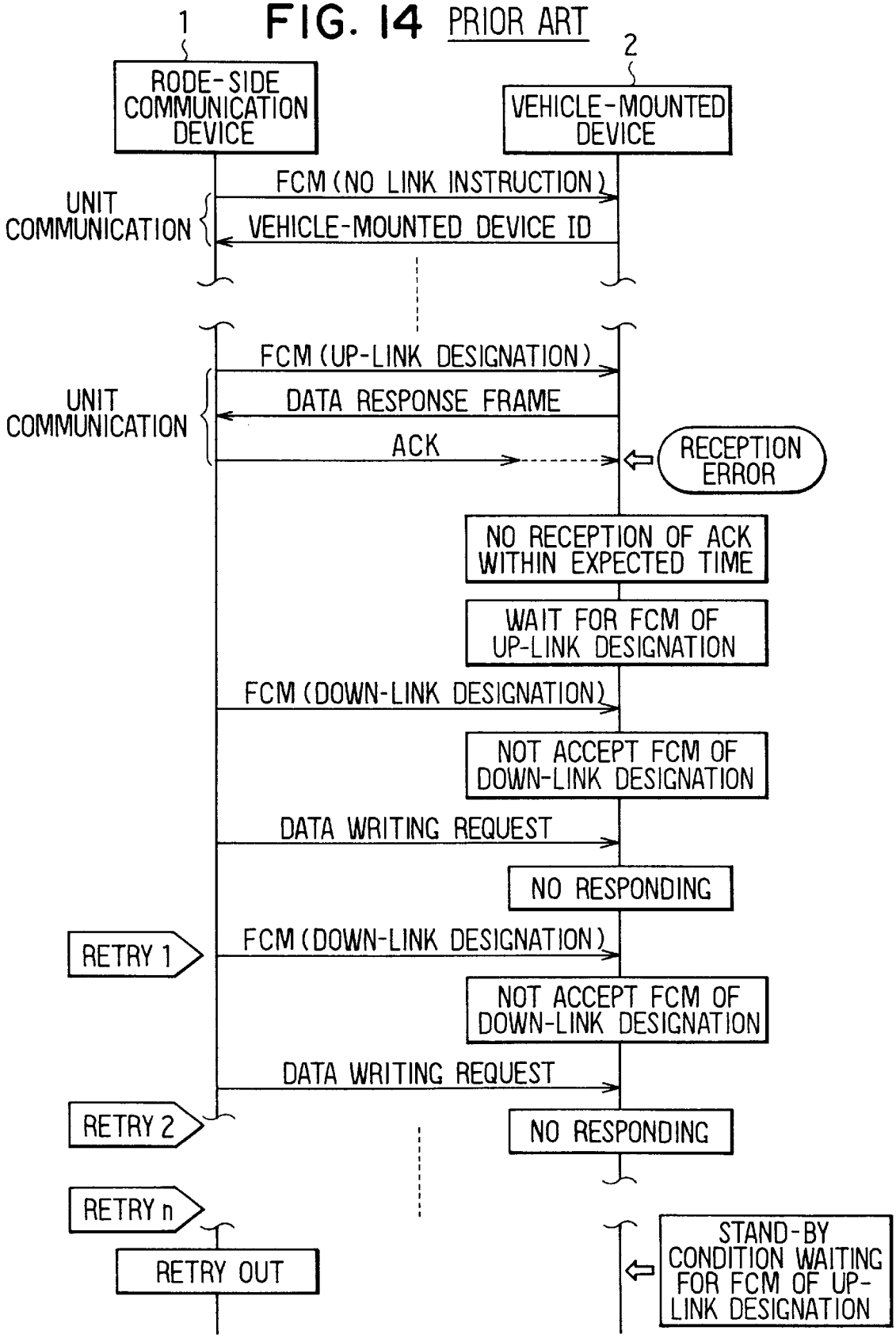
FIG. 14 PRIOR ART
FIG. 14 is a view illustrating an operation of a conventional vehicle-mounted device when a radio signal reception error occurs (corresponding to the first case)
Figure 15:
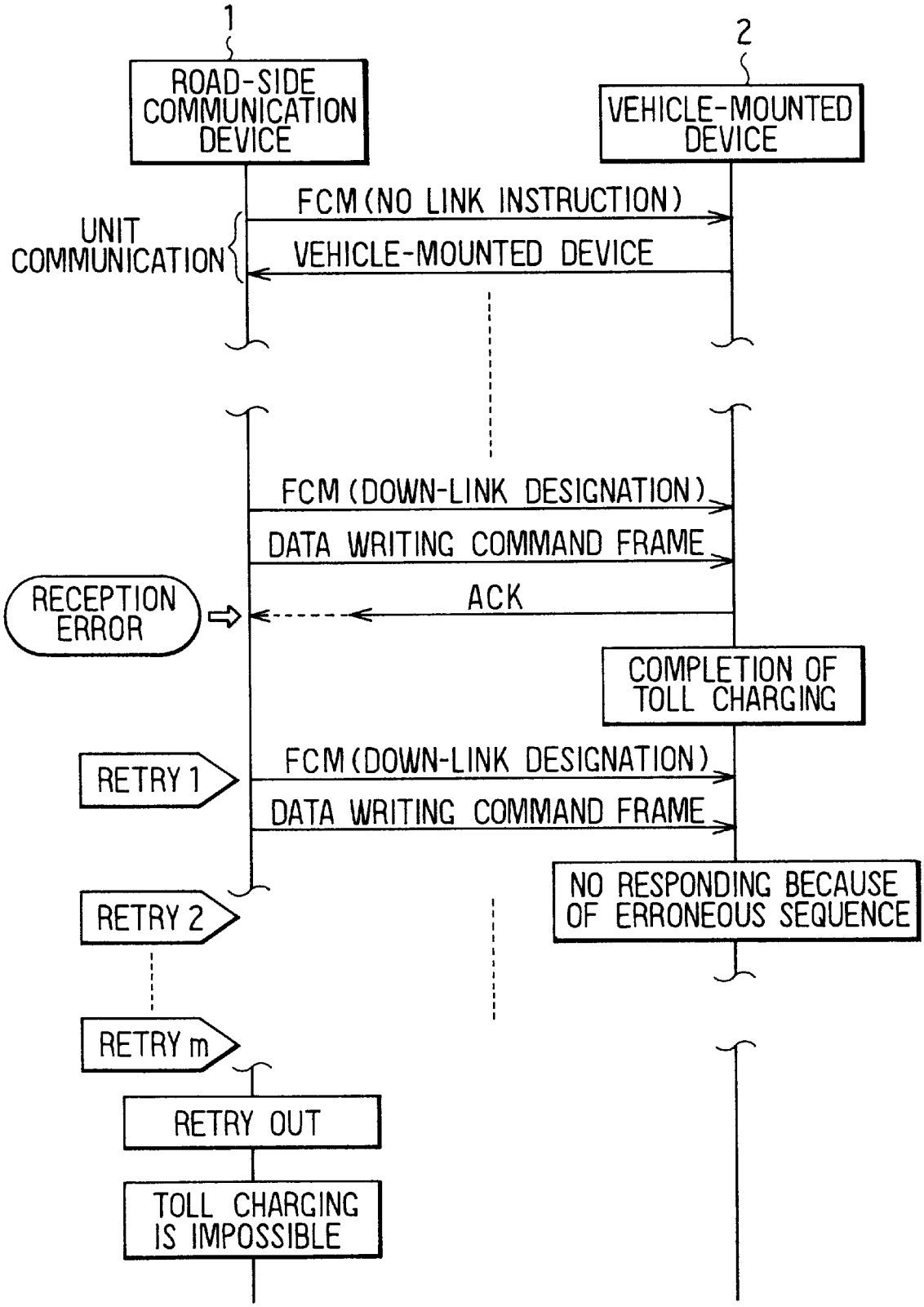
FIG. 15 PRIOR ART
FIG. 15 is a view illustrating an operation of the conventional vehicle-mounted device when a radio signal reception error occurs (corresponding to the fifth case).

As a result, it is possible to promptly proceed with the communication processing without wasting time by unnecessarily repeating the retry processing, differently to the conventional operation described using FIG. 14.

Figure 10:
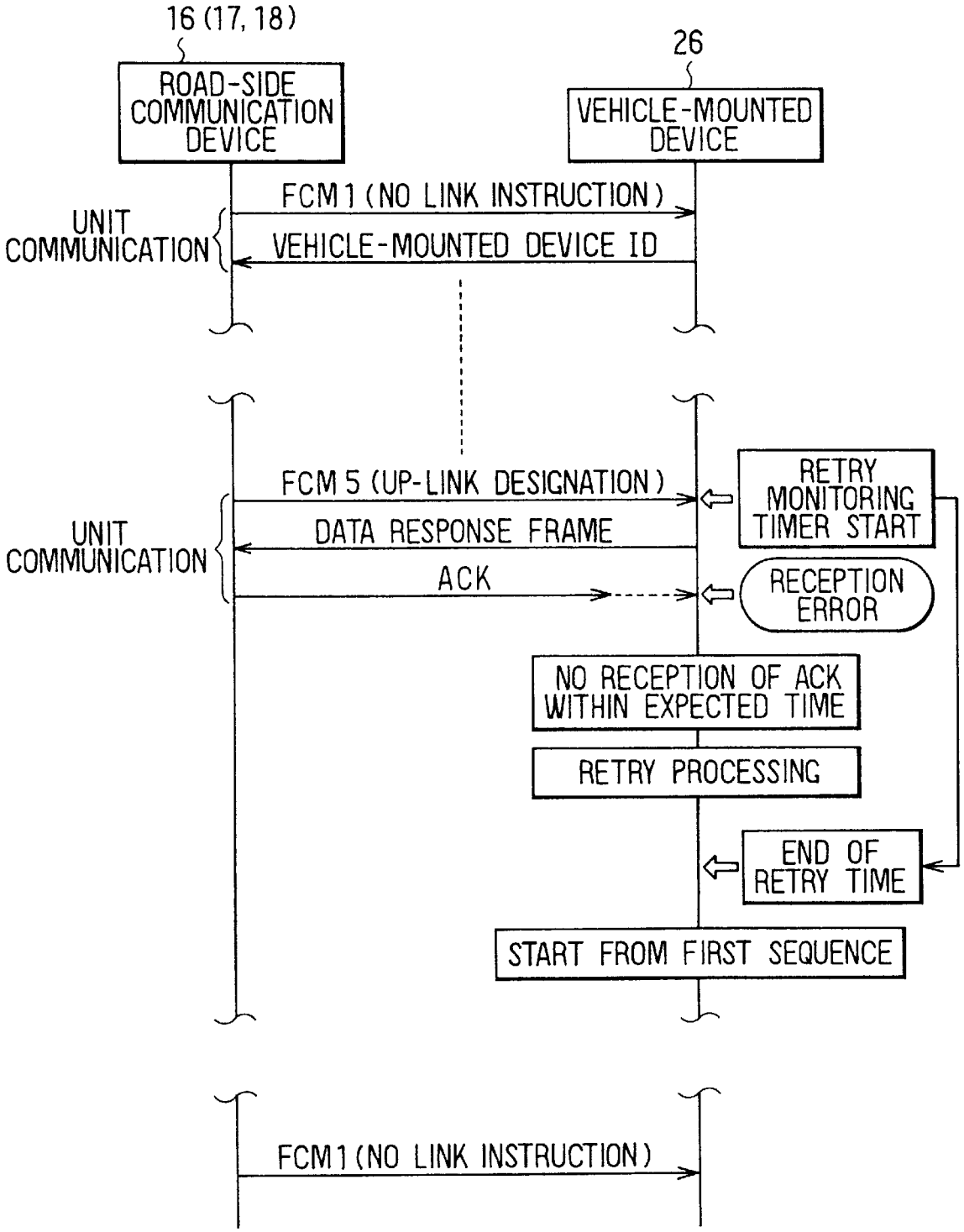
FIG. 10 is a view illustrating an operation of the vehicle-mounted device when a radio signal reception error occurs (second case)

(B) Second Case (referred to FIG. 10, where step 3 in FIG. 1 is carried out)

In the second case, the situation in which the reception error occurs is the same as that in the first case. However, the second case shows a case where the retry time has passed while the vehicle-mounted device 26 is in a stand-by state waiting for the FCM signal to be received. In this case, the vehicle-mounted device 26 starts the communication processing again from the first sequence by taking it as a linkout.

That is, because the vehicle-mounted device 26 does not receive any FCM signal from the road-side communication device 16 within the retry time, the vehicle-mounted device 26 stops the communication processing considering that the sequence failure has occurred in the communication processing. Also, the vehicle-mounted device 26 cancels the established link sequence. After that, the vehicle-mounted device 26 waits for the FCM1 signal of no link directional instruction to start a new communication processing. Therefore, after the vehicle-mounted device 26 falls in a state waiting for the FCM1 signal, even though it receives, for example, the FCM6 signal, it does not respond thereto, thereby causing the road-side communication device 16 to start the new communication processing.

Figure 11:
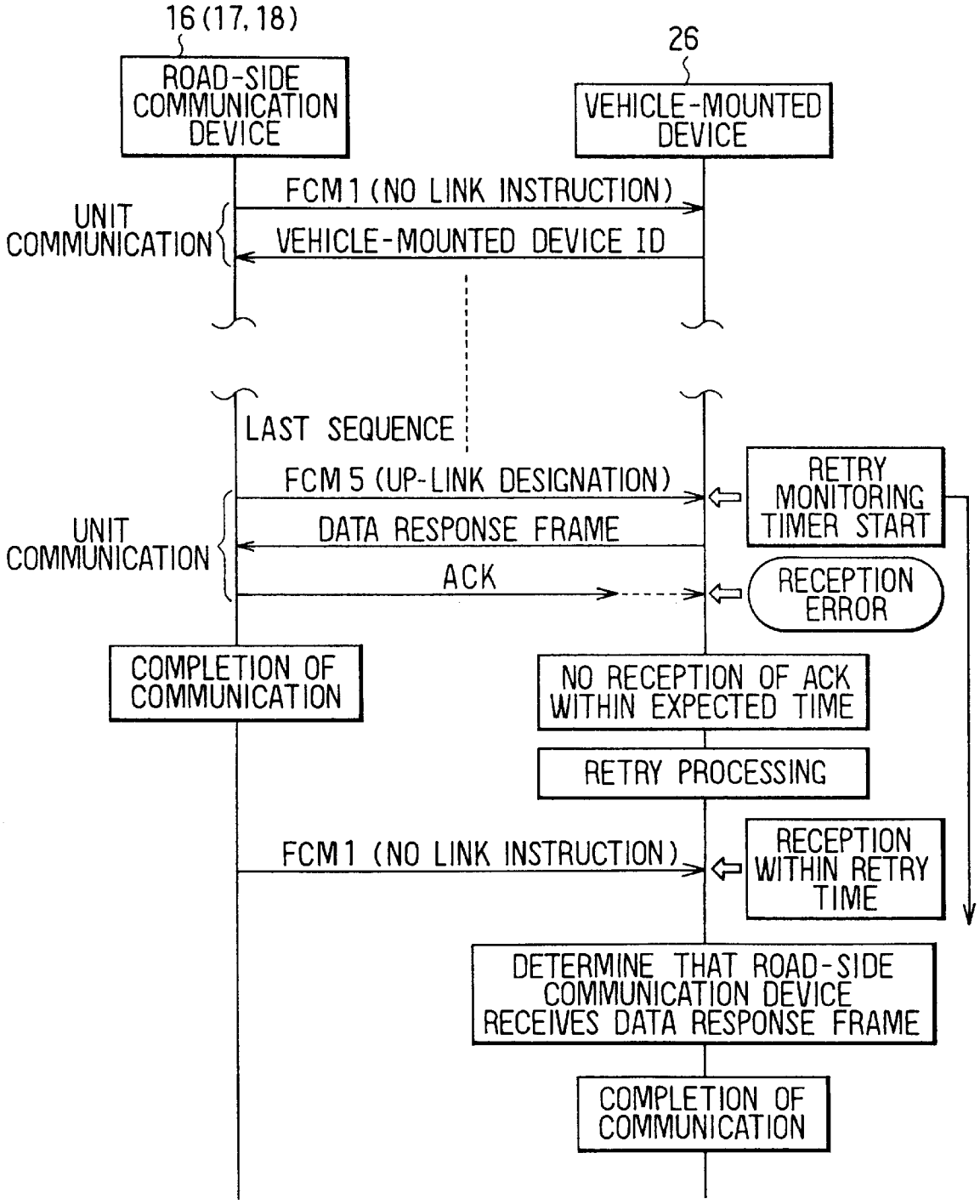
FIG. 11 is a view illustrating an operation of the vehicle-mounted device when a radio signal reception error occurs (third case)

(C) Third case (referred to FIG. 11, where step 12 in FIG. 1 is carried out)

The third case is a case where, the FCM5 signal of an up link designation is one signal included in a last unit communication, although the road-side communication device 16 transmits a last ACK signal in response to receiving the data response frame which is transmitted from the vehicle-mounted device 26 in response to the FCM5 signal, the reception error of the ACK signal occurs at the side of the vehicle-mounted device 26. In this case, the road-side communication device 16 has completed the communication processing by transmitting the last ACK signal. Thereafter, the road-side communication device transmits the FCM 1 signal of no link directional instruction to start communication with another vehicle-mounted device.

When the vehicle-mounted device 26 receives the FCM1 signal of the no link directional instruction before the retry time elapses, the vehicle-mounted device 26 determines that, although the vehicle-mounted device 26 fails to receive the ACK signal at the last sequence, the road-side communication device 16 transmits the FCM1 signal as the result that the communication processing is normally completed therein, and therefore the sequence of the communication processing has been completed between the road-side communication device 16 and the vehicle-mounted device 26. As a result, it is possible to avoid the problem that the vehicle-mounted device 26 keeps waiting for the ACK signal from the road-side communication device 16.

It is to be noted that, if the vehicle-mounted device 26 receives the FCM1 signal after the retry time elapses, because the vehicle-mounted device 26 changes its state to start the communication processing again from the beginning (step 1 and step 3), the vehicle-mounted device 26 carries out the sequence of the communication processing once again. Also, when the vehicle-mounted device 26 receives a signal other than the FCM1 signal after the retry time elapses, the vehicle-mounted device 26 does not respond to the signal and just waits for the FCM1 signal.

In the above-described case, although the vehicle-mounted device 26 does not obtain the ACK signal to be received finally, the road-side communication device 16 has already obtained data with respect to a toll charge. In other word, the communication processing between the road-side communication device 16 and the vehicle-mounted device 26 is substantially completed. Therefore, if the vehicle-mounted device 26 receives the FCM1 signal from the same road-side communication device 16 again, and if the communication processing starts again between the road-side communication device 16 and the vehicle mounted device 26, time is spent on that communication processing unnecessarily.

In this case, it is possible to omit the unnecessary communication processing, for example, by additionally setting a particular communication frame. In detail, when the ID code of the road-side communication device 16 included in the FCM1 signal just received is the same as that of the road-side communication device 16 with which the vehicle-mounted device 26 communicates prior to starting the retry processing, the vehicle-mounted device 26 does not move to a processing for establishing the link sequence, but transmits an information signal to inform that the communication processing with the road-side communication device 16 has completed. When the road-side communication device 16 receives the information signal, the road-side communication device 16 can recognize that the ACK signal transmitted at the final stage is not received by the vehicle-mounted device 26 from a communication history stored thereinside.

Figure 12:
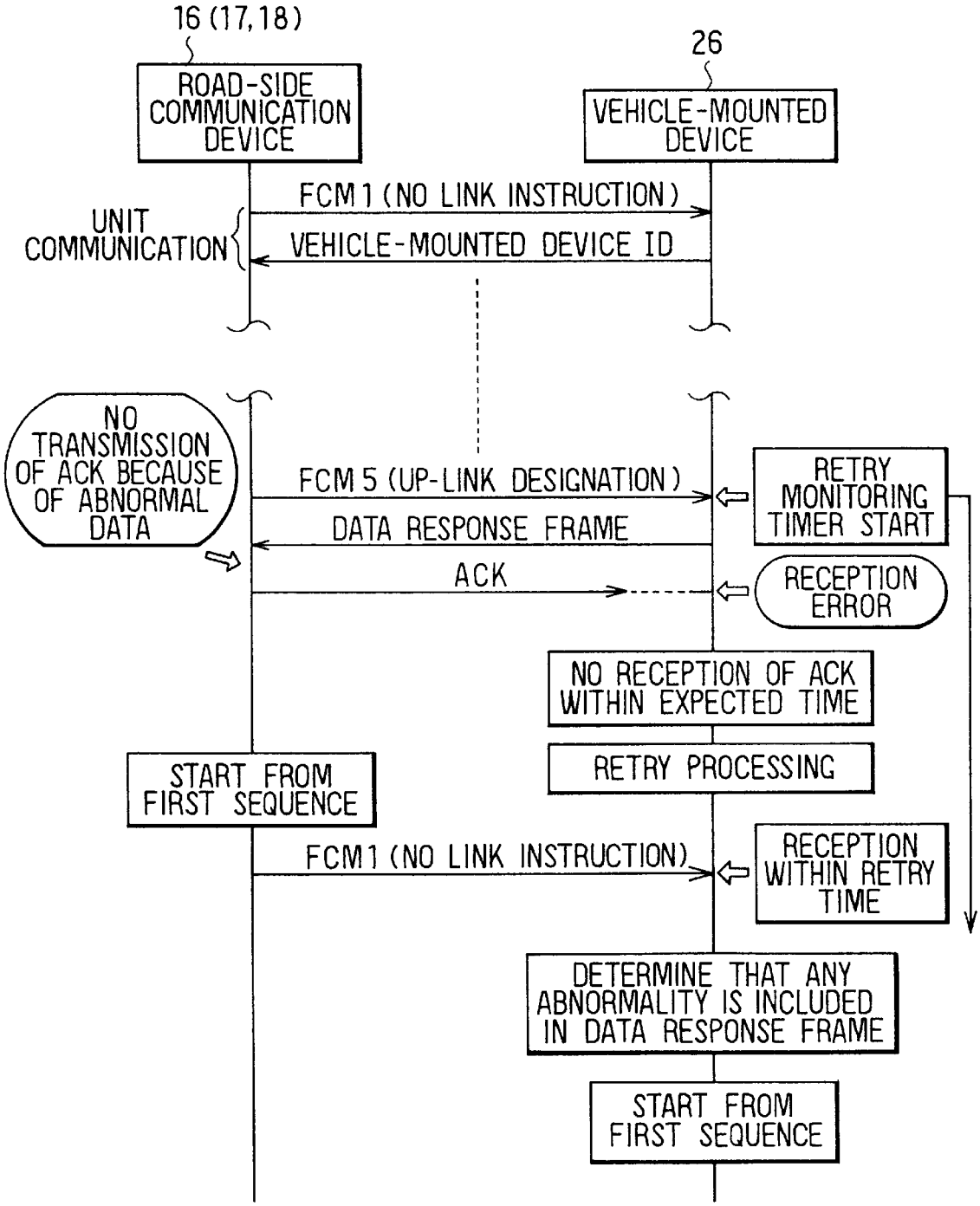
FIG. 12 is a view illustrating an operation of the vehicle-mounted device when a radio signal reception error occurs (fourth case)

(D) Fourth Case (referred to FIG. 12, where steps 9, 10 are carried out from step 11)

The fourth case is a case where, although the road-side communication device 16 receives a data response frame transmitted from the vehicle-mounted device 26, when it cannot return an ACK signal because it is found that abnormal data is included in the data response frame, the vehicle-mounted device 26 does not receive the ACK signal from the road-side communication device 16 even after the expected time elapses. In this fourth case, although it is not a reception error caused by an external factors, because the ACK signal is not received, the vehicle-mounted device 26 starts the retry processing determining that the reception error happens.

In the fourth case, because abnormal data is transmitted from the vehicle-mounted device 26, the road-side communication device 16 transmits the FCM1 signal of no link directional instruction to stop the previous communication processing and to start the communication processing again from the beginning. At that time, the FCM1 signal received within the retry time by the vehicle-mounted device is different from a FCM signal to be received in the communication processing. Further, because the communication processing is not in the final sequence, the vehicle-mounted device 26 determines that the road-side communication device 16 stops the previous communication processing and transmits the FCM1 signal because any abnormality is included in the data response frame transmitted to the road-side communication device 16. As a result, the vehicle mounted device also stop the previous communication processing and starts the communication processing again in response to the FCM1 signal just received. Due to this processing, it is unnecessary to transmit a frame to inform the stop of communication upon receiving abnormal data, like the prior art.

It is to be noted that, when the vehicle-mounted device starts the communication processing again, it may be prohibited to communicate again with the road-side communication device 16, in the communication processing with which any abnormality happened, and a new communication processing may be resumed when the vehicle-mounted device 26 receives a FCM signal from another road-side communication device (of which ID code included in the FCM signal is different from that of the previous road-side communication device 16). Alternatively, when a predetermined time elapses after the stop of the communication processing, the communication processing may be resumed.

Figure 13:
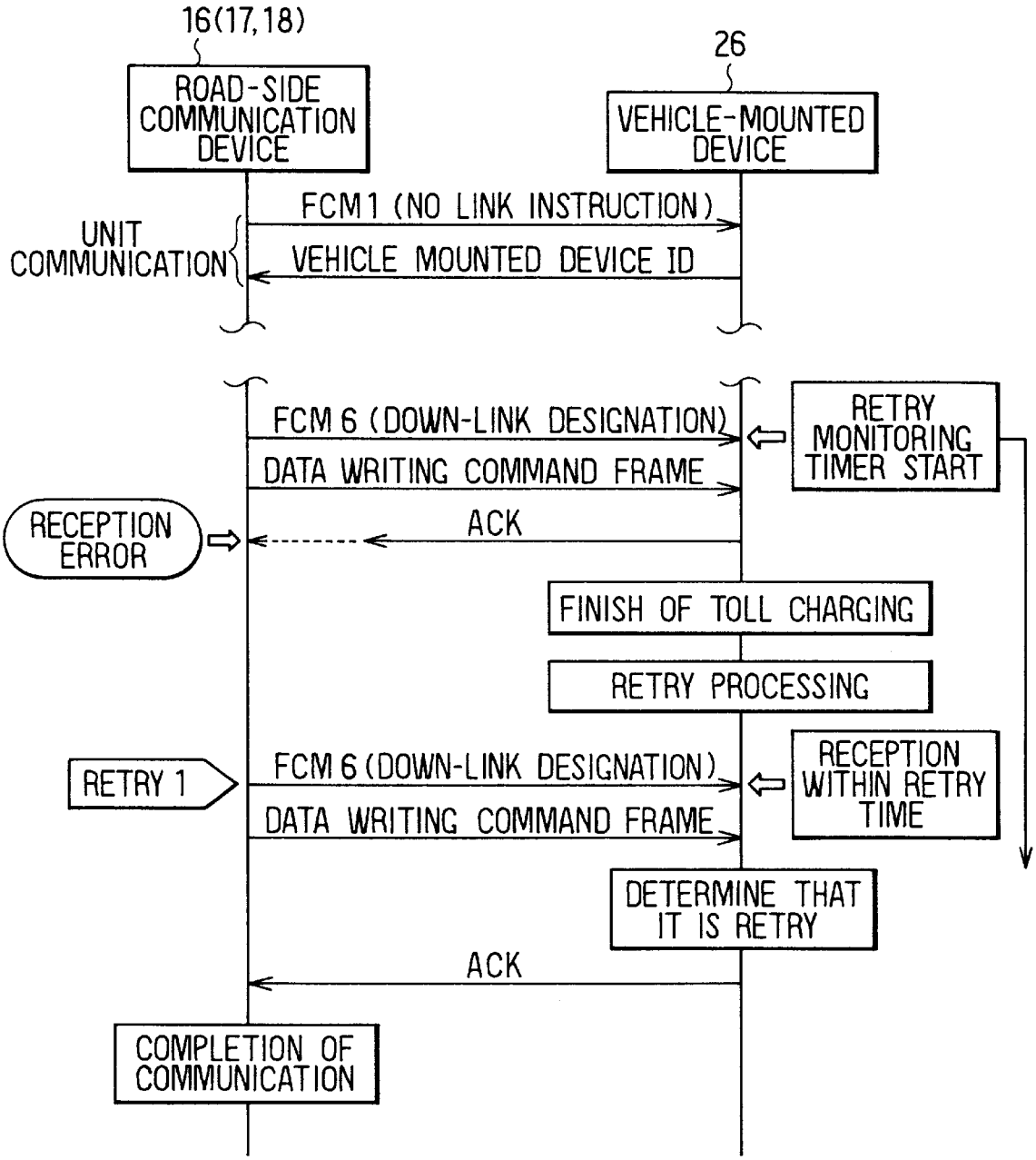
FIG. 13 is a view illustrating an operation of the vehicle-mounted device when a radio signal reception error occurs (fifth case)

(E) Fifth Case (referred to FIG. 13, where the retry processing is carried out after the end of communication)

The fifth case is a case where, although the vehicle-mounted device 26 transmits an ACK signal when the sequence of the communication processing for toll charging is finished at the vehicle-mounted device side, the road-side communication device 16 fails to receive the ACK signal, that is, the reception error of the ACK signal occurs at the side of the road-side communication device 16. In this case, the vehicle-mounted device 26 starts the retry processing after transmitting the ACK signal which is a last signal of communication to cope with the ACK signal reception error which might occur at the road-side communication device side.

When the road-side communication device 16 receives the ACK signal transmitted from the vehicle-mounted device 26, because the sequence of communication processing is normally completed, the road-side communication device 16 finishes the communication processing and transmits again the FCM1 signal of no link directional instruction to start new communication. When the vehicle-mounted device 26 receives the FCM1 signal before the retry time elapses, it determines that the communication processing is normally completed (at step 12 of FIG. 1) in the same manner as the above-described third case.

However, as shown in FIG. 13, when the reception error of the ACK signal occurs at the road-side communication device 16, the road-side communication device 16 starts the retry processing. That is, the road-side communication device 16 transmits again the FCM6 signal of the down link designation which was sent before the occurrence of the ACK signal reception error. Because the vehicle-mounted device 26 receives the FCM6 signal which has the same link directional instruction as the previous FCM signal within the retry time, it determines that the reception error of the ACK signal transmitted therefrom occurs at the road-side communication device 16. In this case, the vehicle-mounted device 26 transmits again the ACK signal after receiving the data writing command frame. Thereby, the road-side communication device 16 receives the ACK signal, finishes the communication processing and then starts to transmit the FCM1 signal of no link directional instruction. When the vehicle-mounted device 26 receives the FCM1 signal before the retry time elapses, it determines that the communication processing is normally completed (at step 12 of FIG. 1) in the same manner as described above. It is to be noted that the vehicle-mounted device 26 is programmed so as not to execute double toll charging by the data writing command frame received during the retry processing in addition to the toll charging which has been done.

According to the embodiment as described above, the vehicle-mounted device 26 carries out the retry processing if the signal to be received is not received within the expected time. In the retry processing, the vehicle-mounted device 26 controls progressing of the following communication processing based on the link directional instruction included in the FCM signal received within the retry time and the progressing state of the communication processing at that time. Therefore, the sequence of the communication processing can be carried out promptly and certainly, compared to the communication procedure in which retry processing is simply repeated. As a result, because communication between the road-side communication device 16 and the vehicle-mounted device 26 can be efficiently carried out, it is possible to prevent an incomplete toll charging due to a communication signal reception error. Further, when the road-side communication device 16 concurrently communicates with at least one of other vehicle-mounted devices, it is possible to prevent the communication processing between one vehicle-mounted device 26 and the road-side communication device 16 from wasting a communication time for the other moving-body communication devices.

The present invention is not limited to the above-described embodiment, but can be modified and extended without departing from the spirit and the scope as set out in the accompanying claims.

For example, although the retry processing is carried out by software in the above-described embodiment, a logic circuit constituted by hardware may be adopted to determine the contents of the FCM signal and the command, and to execute various kinds of processing in response thereto.

The retry time can be set based on not only the number of the retry operations, the duration of the frame and the number of the time division but also the other factors other than those. Also, the retry time can be determined based on only the other factors without using the number of the retry operations, the duration of the frame and the number of the time division.

Although the retry monitoring timer starts to count the retry time when the vehicle-mounted device 26 receives the signal from the road-side communication device 16, the retry monitoring timer may start to count the retry time from the time point at which it is determined that the reception error occurs. Further, the retry monitoring timer can start to count from an arbitrary time point.

The present invention can be applied to communication processing between a high frequency tag, which is mounted on a moving body and stores various kinds of data, and a communication device for communicating therewith, other than the automatic toll collection system for a toll road.

Further, the present invention can be applied to communication processing between an interrogator and a transponder to control entering and leaving of palettes in a distribution factory.

The moving body for the communication device to be mounted is not limited to an automobile, but can be a vehicle such as a motorcycle, a bicycle or a train, or a ship or an airplane.

In the above-described embodiment, only the communication example in which the FCM signal of the up-link designation and the FCM signal of the down-link designation are alternatively transmitted from the road-side communication device 16 is described for brevity's sake. However, in the actual communication, there is a case in which, for example, the FCM signals of the up-link designation are successively transmitted from the road-side communication device 16. This is because, when the volume of data transmitted from the vehicle-mounted device 26 is too large to be nested into one communication frame, that data is divided into two or more frames. In this case, when the road-side communication device 16 receives a first data response frame from the vehicle-mounted device 26, the road-side communication device 16 recognizes that data is not completely transmitted from the vehicle-mounted device 26. Therefore, the road-side communication device 16 transmits again the FCM signal of the up link designation. Therefore, if the vehicle-mounted device 26 receives the FCM signal of the down link designation or the FCM signal of no link directional instruction at that time, it can be determined that any failure occurs in the communication processing between the vehicle-mounted device 26 and the road-side communication device 16. In this case, the communication processing is started again from the beginning.

What is claimed is:

1. A moving-body communication device which is mounted on a moving body and starts to communicate with an interrogator in response to a signal from the interrogator to execute a sequence of communication processing when passing through a communication area of the interrogator, said moving-body communication device comprising:

a communication control device for carrying out a retry processing which controls progress of said communication processing to be continued in consideration of a progressing state of said communication processing which has already been carried out, when the moving-body communication device does not receive a signal that is transmitted from the interrogator and is to be received thereby within an expected time, wherein said communication control device allows a data signal to be received or to be transmitted in accordance with a link direction representing that the data signal is to be received by said moving-body communication device or is to be transmitted from said moving-body communication device, said link direction being specified by the signal transmitted from said interrogator, and wherein said communication control device carries out a step of said communication processing in accordance with contents of a signal transmitted from said interrogator after said retry processing starts, when the link direction specified by the signal transmitted from said interrogator after said retry processing starts is different from that specified by the signal from said interrogator immediately before said retry processing starts and when the progressing state of said communication processing is not in a last step.

2. A moving-body communication device according to claim 1, wherein said communication control device controls progress of said communication processing in accordance with contents of a signal that said moving-body communication device receives from said interrogator after said retry processing starts.

3. A moving-body communication device according to claim 2, wherein said communication control device stops said communication processing and starts communication again from the beginning when said moving body communication device does not receive a signal from said interrogator within a predetermined retry time after said retry processing starts.

4. A moving-body communication device according to claim 1, wherein said communication control device allows the data signal to be received or to be transmitted at timing specified by the signal transmitted from said interrogator.

5. A moving-body communication device according to claim 1, wherein communication control device allows a response signal to be transmitted at timing specified by the signal transmitted from said interrogator to start to communicate therewith.

6. A moving-body communication device according to claim 1, wherein said communication control device carries out a step of said communication processing identical to that carried out immediately before said retry processing starts, when the link direction specified by the signal transmitted from said interrogator after said retry processing starts is the same as that specified by the signal from said interrogator immediately before said retry processing starts.

7. A moving-body communication device according to claim 1, wherein said communication control device carries out said retry processing after a last signal of said communication processing is transmitted from said moving-body communication device, and said communication control determines that said communication processing is completed when said moving-body communication device receives a signal which does not include an instruction with respect to the link direction from said interrogator in said retry processing.

8. A moving-body communication device which is mounted on a moving body and starts to communicate with an interrogator in response to a signal from the interrogator to execute a sequence of communication processing when passing through a communication area of the interrogator, said moving-body communication device comprising:

a communication control device for carrying out a retry processing which controls progress of said communication processing to be continued in consideration of a progressing state of said communication processing which has already been carried out, when the moving-body communication device does not receive a signal that is transmitted from the interrogator and is to be received thereby within an expected time, wherein said communication control device allows a data signal to be received or to be transmitted in accordance with a link direction representing that the data signal is to be received by said moving-body communication device or is to be transmitted from said moving-body communication device, said link direction being specified by the signal transmitted from said interrogator, and wherein said communication control device stops said communication processing as it is incomplete, when the link direction specified by the signal transmitted from said interrogator after said retry processing starts is different from that specified by the signal from said interrogator immediately before said retry processing starts and when the progressing state of said communication processing is in a last step.

9. A moving-body communication device which is mounted on a moving body and starts to communicate with an interrogator in response to a signal from the interrogator to execute a sequence of communication processing when passing through a communication area of the interrogator, said moving-body communication device comprising:

a communication control device for carrying out a retry processing which controls progress of said communication processing to be continued in consideration of a progressing state of said communication processing which has already been carried out, when the moving-body communication device does not receive a signal that is transmitted from the interrogator and is to be received thereby within an expected time, wherein said communication control device allows a data signal to be received or to be transmitted in accordance with a link direction representing that the data signal is to be received by said moving-body communication device or is to be transmitted from said moving-body communication device, said link direction being specified by the signal transmitted from said interrogator, and wherein said communication control device determines that said communication processing is completed, when said moving-body communication device receives a signal which does not include an instruction with respect to the link direction from said interrogator after said retry processing starts and when the progressing state of said communication processing is in a last step.

10. A moving-body communication device which is mounted on a moving body and starts to communicate with an interrogator in response to a signal from the interrogator to execute a sequence of communication processing when passing through a communication area of the interrogator, said moving-body communication device comprising:

a communication control device for carrying out a retry processing which controls progress of said communication processing to be continued in consideration of a progressing state of said communication processing which has already been carried out, when the moving-body communication device does not receive a signal that is transmitted from the interrogator and is to be received thereby within an expected time, wherein said communication control device allows a data signal to be received or to be transmitted in accordance with a link direction representing that the data signal is to be received by said moving-body communication device or is to be transmitted from said moving-body communication device, said link direction being specified by the signal transmitted from said interrogator, and wherein said communication control device stops said communication processing as it is incomplete, when said moving-body communication device receives a signal which does not include an instruction with respect to the link direction from said interrogator after said retry processing starts and when the progressing state of said communication processing is not in a last step.

11. A vehicle-mounted device which is mounted on a vehicle and starts to communicate with a road-side communication device in response to a radio signal from said road-side communication device to execute a sequence of communication processing when passing through a communication area of said road-side communication device, said moving-body communication device comprising:

a communication control device for determining a step of said communication processing to be continued when deciding an occurrence of a reception error of an acknowledgement signal from contents of last time communication processing and contents of present communication processing, wherein said communication control device allows a data signal to be received or to be transmitted in accordance with a link direction representing that the data signal is to be received by said vehicle-mounted device or is to be transmitted from said vehicle-mounted device, said link direction being specified by the signal transmitted from said road-side communication device, and wherein said communication control device decides that the reception error of the acknowledgement signal occurs at said road-side communication device when the signal transmitted from said road-side communication device in said present communication processing has the same link direction as that specified by the signal of said last time communication processing after said acknowledgement signal is transmitted from the vehicle-mounted device to said road-side communication device.

12. A vehicle-mounted device according to claim 11, wherein said communication control device prohibits carrying out a step of said communication processing in accordance with the signal transmitted from said road-side communication device in said present communication processing.

13. A vehicle-mounted device according to claim 12, wherein said communication control device allows the acknowledgement signal to be transmitted again in response to the signal transmitted from said road-side communication device in said present communication processing.

* * * * *